US005141205A

United States Patent [19]

Iwai et al.

[11] Patent Number: 5,141,205

[45] Date of Patent: Aug. 25, 1992

[54] NAIL REMOVER

[75] Inventors: Hideo Iwai, Fukuoka; Mikihiko Yoshida, Ibaraki; Michiharu Obata, Fukuoka; Yoshiyuki Okayasu, Saitama, all of Japan

[73] Assignees: Okabe Co., Ltd., Fukuoka; Iwai Industry Co., Ltd., Tokyo, both of Japan

[21] Appl. No.: 826,685

[22] Filed: Jan. 29, 1992

Related U.S. Application Data

[63] Continuation of Ser. No. 636,432, Dec. 31, 1990, abandoned.

[30] Foreign Application Priority Data

May 24, 1990 [JP] Japan ..... 88-54328[U]

[51] Int. Cl.[5] ..... B66F 15/00

[52] U.S. Cl. ..... 254/18; 29/243.54; 254/21

[58] Field of Search ..... 29/243.54, 243.53, 243.5; 227/156, 63, 130; 254/28, 18, 21

[56] References Cited

U.S. PATENT DOCUMENTS

| | | | |
|---|---|---|---|
| 968,688 | 8/1910 | Redmond | 254/18 |
| 1,575,582 | 3/1926 | Joy | 227/156 |
| 2,274,091 | 2/1942 | Pavlecka et al. | 29/243.54 |
| 3,135,141 | 6/1964 | Aitken | 29/243.54 |
| 4,026,521 | 5/1977 | Clark | 254/28 |
| 4,602,414 | 7/1986 | Bartholomew et al. | 227/156 |
| 4,637,113 | 1/1987 | Cook | 29/243.54 |
| 4,637,538 | 1/1987 | Wagner | 227/63 |
| 4,775,090 | 10/1988 | Kuo | 227/156 |
| 4,918,798 | 4/1990 | Reed | 29/243.54 |

*Primary Examiner*—Robert C. Watson

*Attorney, Agent, or Firm*—Wenderoth, Lind & Ponack

[57] ABSTRACT

A nail remover according to the present invention includes a tool head having a guide bore extending linearly through the head in a longitudinal direction, a push-rod slidably mounted in the guide bore of the head between a retracted position at which a free end of the push-rod is located in the guide bore and an extended position at which the free end of the push-rod protrudes from the guide bore, a driving device for advancing the push-rod from the retracted position to the extended position, and an actuator for activating the driving device. At least a portion of the peripheral wall defining an outlet of the guide bore is tapered toward an outboard edge of the wall so as to make it easy to introduce a nail into the guide bore. In operation, the guide bore receives the portion of a nail protruding from a plate such as a piece of plywood. Then the nail is straightened by aligning the guide bore with the axis of the nail and, thereafter, the push-rod is driven towards the extended position so as to drive the nail out of the plate.

6 Claims, 5 Drawing Sheets

NAIL REMOVER

This application is a continuation of now abandoned application, Ser. No. 07/636,432, filed Dec. 31, 1990, now abandoned.

BACKGROUND OF THE INVENTION

1. Field of the Invention

The present invention relates to a nail remover for removing a nail from a plywood end plate of a formwork which has been disassembled after it was used to construct a concrete building.

2. Related Prior Art

In order to construct a concrete building, a formwork is firstly assembled and then concrete is deposited in the formwork. When the concrete is cured, the formwork is disassembled.

In the disassembling of the formwork, in which a wooden crosspiece b is attached to a piece of plywood a by means of a nail c as shown in FIG. 9, crowbar d is driven in between the plywood a and the crosspiece b as shown in FIG. 10, so that the plywood a is separated from the cross-piece wood b by forcibly urging the latter downwardly by means of the crowbar d. Thereafter, pieces of the plywoods a are stacked and transported in the stacked condition.

The nail c remaining in the plywood a is almost always not straight (unlike a new nail), and thus is curved or is it is bent into contact with a surface of the plywood a as shown in FIG. 11 in the worst case.

Whenever the formwork is assembled again after the formwork has been disassembled, the nails c remaining in the plywood a of the end plate must be removed.

To perform such a nail removing operation in a conventional method, first of all, the nail c which is curved or which is bent into contact with the surface of the plywood a as shown in FIG. 11 is cocked uprightly by a hammer f having a nail puller portion e, as shown in FIG. 12. Thereafter, as shown in FIG. 13, the pointed end of the nail c is struck by the hammer f to separate a head g of the nail c from the surface of the plywood a so that the head g can be hooked by means of a nail puller portion e of the hammer g. Then, as shown in FIG. 14, the plywood a is turned over and the head g of the nail c is hooked by the nail puller portion e of the hammer f. Then, by pulling the nail c upwardly with the hammer f, the nail is removed from the plywood a, as shown in FIG. 15.

However, the above-mentioned conventional nail removing method has the disadvantages that considerable effort and time are required because an operator must strike the nail repeatedly with the hammer to cock the bent nail upright heavy labor is required, and because the large and heavy plywood must be turned over.

SUMMARY OF THE INVENTION

An object of the present invention is to provide a nail remover which can eliminate the above-mentioned conventional drawbacks.

Accordingly, a nail remover according to the present invention comprises a head having a guide bore extending linearly through the head in a longitudinal direction thereof, a push-rod slidably mounted in the guide bore of the head between a retracted position in which a free end of the push-rod is is disposed in the guide bore and an extended position in which the free end of the push-rod protrudes from the guide bore. a driving mask means for driving or advancing the push-rod from the retracted position to the extended position, and an actuator means for activating the driving means, and is characterized in that at least a portion of a peripheral wall defining an outlet of the guide bore is tapered toward an outboard edge of the wall.

In the nail removing operation, an operator manipulates the nail remover so that the nail remaining on the plywood is inserted from its pointed end into the guide bore of the head. If a portion of the nail protruding from the plywood is bent into contact with the surface of the plywood, the tapered peripheral wall portion formed in the outer end of the head is wedged between the surface of the plywood and the nail to insert the nail into the guide bore. Then, the nail remover is cocked so that the guide bore is oriented perpendicularly with respect to the plywood, thus straightening the nail. Thereafter, the actuator means is energized to activate the driving means so that the push-rod is extended to push the nail out of the plywood.

According to a preferred embodiment of the present invention, the guide throughbore has a substantially uniform diameter between a front or outer end to a rear end thereof, and the above-mentioned tapered configuration is provided by an inclined outer surface of at least a portion of the peripheral wall g the head adjacent the front of the guide bore.

According to another embodiment of the present invention, the guide througbore has a substantially uniform diameter ones the whole length thereof, and, at least a portion of the guide bore diverges toward the front of the head. The tapered configuration is provided by the diverged portion of the guide bore and the corresponding outer surface of the head.

Preferably, a concave recess is formed in the free end of the push-rod so that the head of the nail can be stably engaged by the end surface of the push-rod.

According to a further embodiment of the present invention, the driving means comprises a piston/cylinder assembly having a piston pneumatically driven in an advancing direction, and the push-rod is fixed to a center of the piston at a front surface thereof.

BRIEF DESCRIPTION OF THE DRAWINGS

FIGS. 5 to 7 are explanatory partial sectional views, wherein FIG. 5 shows a state in which a protruded nail portion is to be inserted into a guide throughbore of a head of the nail remover, FIG. 6 shows a state in which the protruded nail portion is cocked uprightly, and FIG. 7 shows a state in which the nail has been removed from a piece of plywood;

FIGS. 9 to 11 are explanatory sectional views illustrating the removal of a wooden from a piece of plywood, wherein FIG. 9 shows a state in which the crosspiece is attached to the plywood, FIG. 10 shows a state in which the crosspiece is being separated from the plywood, and FIG. 11 shows a state in which a remains nail in the plywood after the crosspiece has been removed;

FIGS. 12 to 15 are explanatory sectional views illustrating a conventional nail removing operation, wherein FIG. 12 shows a state in which the protruded nail portion is cocked upright, FIG. 13 shows a state in which a head of the nail is separated from the surface of the plywood, FIG. 14 shows a state in which the plywood is turned over and a nail puller portion of a hammer is wedged between the nail head and the plywood, and FIG. 15 shows a state in which the nail is removed from the plywood.

DETAILED DESCRIPTION OF THE PREFERRED EMBODIMENTS

Figure 1:
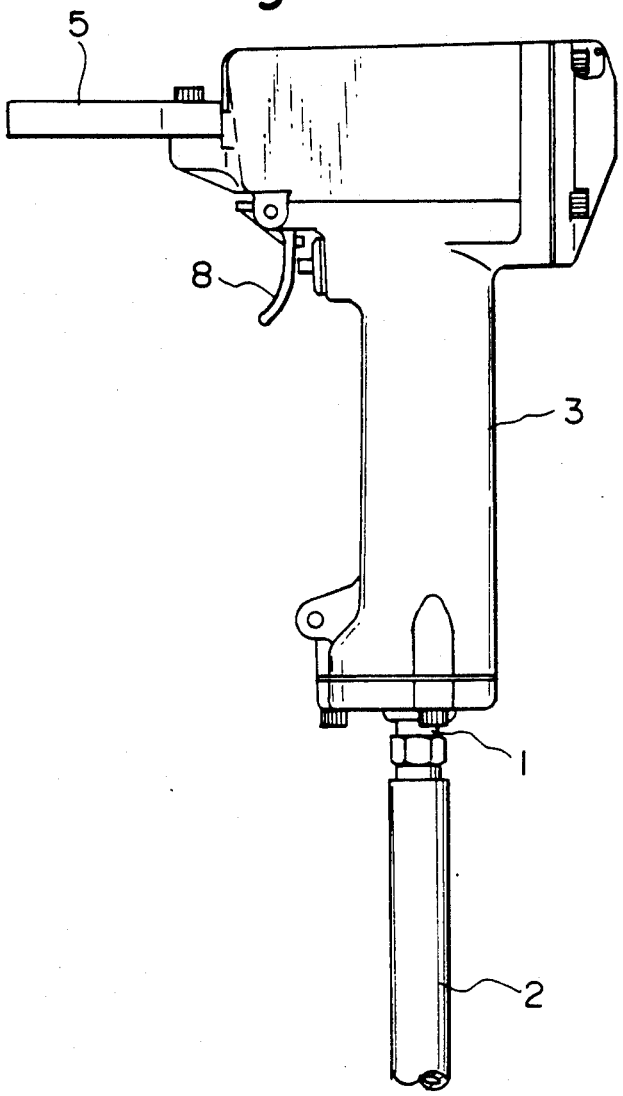
FIG. 1 is an elevational view of a nail remover according to a preferred embodiment of the present invention.
Figure 2:
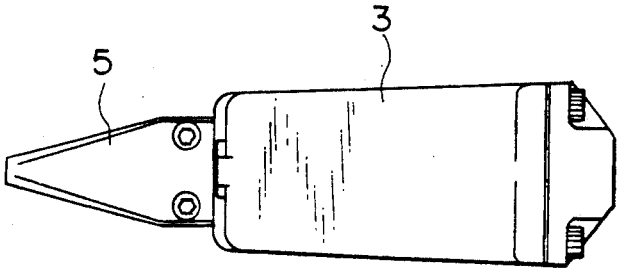
FIG. 2 is a plan view of the nail remover of FIG. 1.

Explaining a first embodiment according to the present invention shown in FIGS. 1 to 7, reference numeral 3 denotes a gun body of a nail remover, which has an air inlet fitting 1 connected to a compressor (not shown) via a hose 2. At an upper portion of the gun body, a cylinder 4 extending in a fore and aft directions is disposed within the body, and a triangular head 5 having both lateral surfaces inclined forwardly and inwardly is arranged ahead of the cylinder. A guide bore 7 is formed in a central portion of the head 5, which guide bore extends in fore and aft directions and has a flared front end portion 6. The guide bore is aligned with the cylinder 4. Reference numeral 8 denotes a trigger for the gun 3; 9 denotes a piston mounted in the cylinder 4; and 10 denotes a push-rod having a base end fixed to the piston 9 and a free end which has a semi-spherical recess 14. When the trigger 8 of the gun 3 is pulled, the pressurized air is introduced into a rear chamber in the cylinder 4 from the compressor through the inlet fitting 4 and the gun body 3, whereby the push-rod 10 is advanced forwardly in the guide bore 7 of the head 5 to protrude from the head by an appropriate length such as 7 mm, as shown by a two-dot chain line in FIG. 3. Thereafter, when the trigger 8 is released, the pressurized air is introduced into a front chamber of the cylinder 4, whereby the piston 9 is retracted or returned as shown by a broken line in FIG. 3, with the result that the push-rod 10 is retracted up to a home position in the guide bore 7 of the head 5.

Reference numeral 11 denotes a piece of plywood used as an end plate of a concrete formwork; 12 denotes a nail remaining in the plywood 11 after a crosspiece is removed from the plywood; and 13 denotes a hole formed in the plywood 11 by driving the nail into the plywood.

Figure 5:
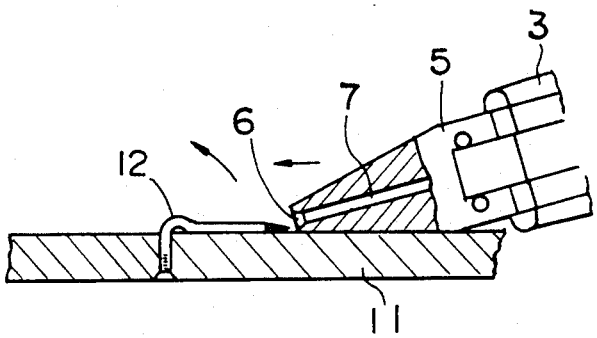

As shown in FIG. 5, when a protruded portion of the nail 12 is bent to contact a surface of the plywood 11, the inclined lateral surface of the head 5 is rested on the plywood 11 in such a manner that the guide bore 7 is opposed to the pointed end of the nail 12. Then, the inclined lateral surface of the head 5 is slid on the plywood 11 to urge the head 5 against the nail 12, with the result that a tapered peripheral wall portion, defined between the inclined lateral surface and the flared end portion 6 of the guide bore 7 is wedged between the nail and the plywood surface, thus introducing the free end of the nail into the guide bore 7 of the head 6 through the flared end portion 6.

Figure 6:
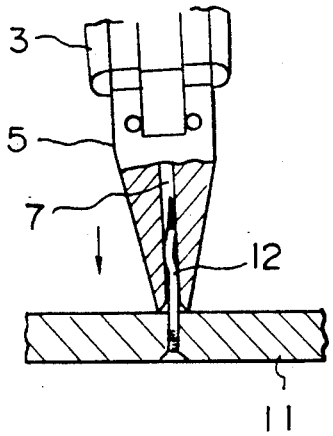

Then, the head 5 is gradually cocked uprightly while inserting the protruded portion of the nail 12 into the guide bore 7 so that the guide bore 7 of the head 5 is oriented perpendicularly with respect to the surface of the plywood 11, thus straightening the protruded portion of the nail 12, as shown in FIG. 6.

Figure 7:
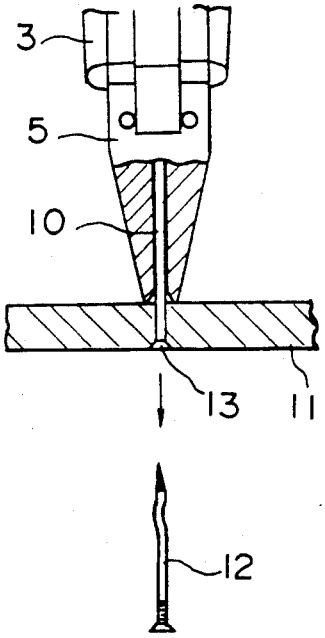

Thereafter, the trigger 8 is pulled. Consequently, the piston 9 is advanced by the action of the pressurized air to force the end of the push-rod 10 defining semi-spherical recess 14 into engagement with the pointed end of the nail 12 and then to push the nail 12 along the guide bore 7 of the head 5 and through the hole 13 of the plywood 11, with the result that the push-rod 10 is also advanced from the guide bore 7 of the head 5 into the hole 13 of the plywood 11, thus pushing the nail 12 out of the hole 13 of the plywood 11, as shown in FIG. 7. In this way, the nail is removed from the plywood.

Figure 3:
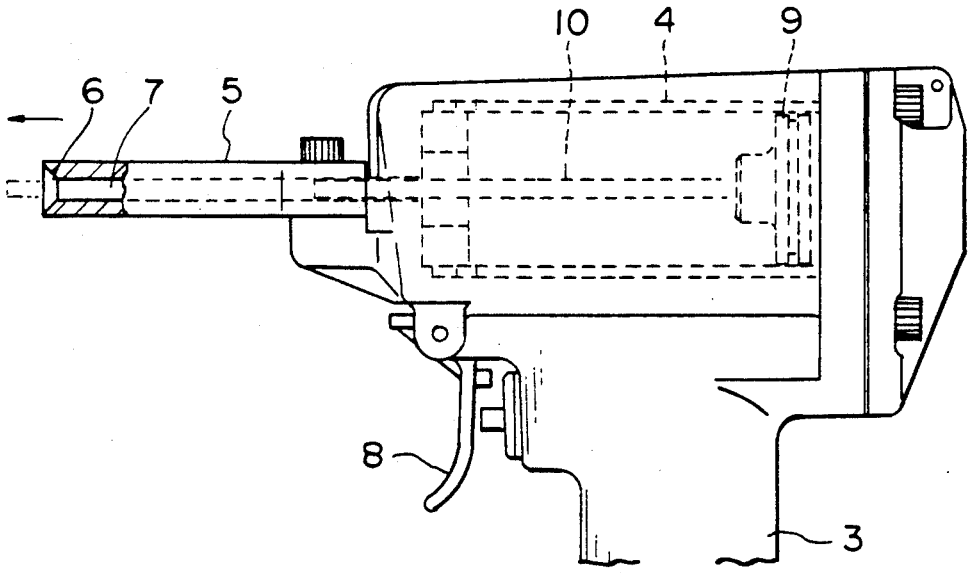
FIG. 3 is an enlarged elevational view, partially in section, of an upper main portion of the nail remover.
Figure 4:
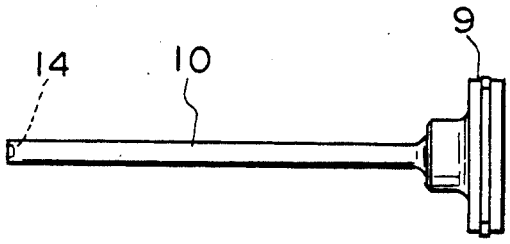
FIG. 4 is a side view of a piston with a push-rod.

Then, when the trigger 8 is released, the piston 9 with the push-rod 10 is retracted by the action of the pressurized air to the home position, as shown by the broken line in FIG. 3.

The above-mentioned operation is repeated for each of the nails remaining in the plywood.

It should be noted that the nail remover according to the present invention can be used for removing nails remaining in other plates and the like, in the same manner.

Figure 8:
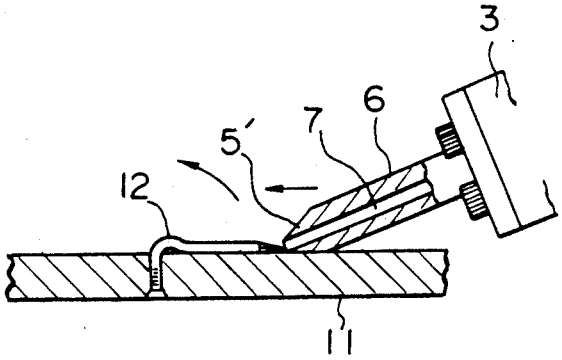
FIG. 8 is a sectional view of a head of a nail remover according to another embodiment of the present invention.
Figure 9:
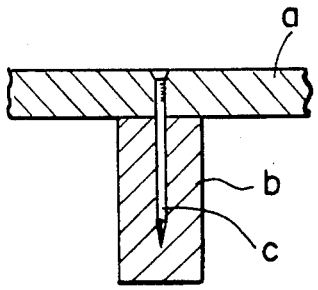
Figure 10:
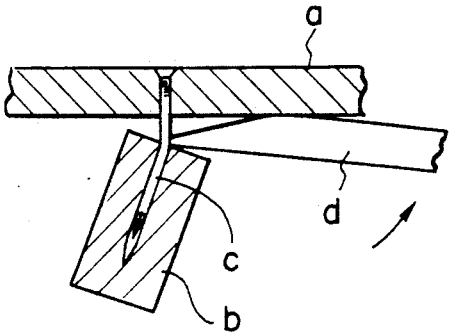
Figure 11:
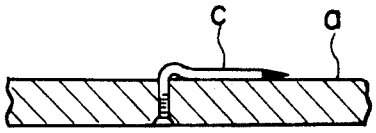
Figure 12:
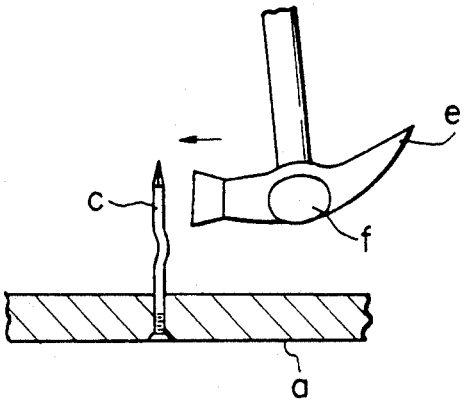
Fig. 12 PRIOR ART
Figure 13:
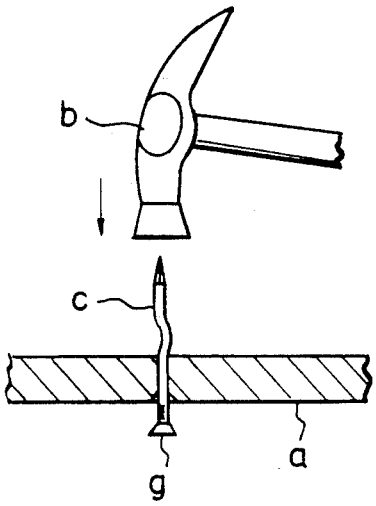
Fig. 13 PRIOR ART
Figure 14:
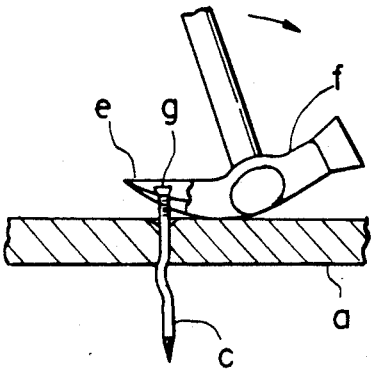
Fig. 14 PRIOR ART
Figure 15:
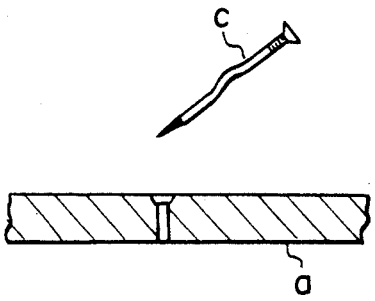
Fig. 15 PRIOR ART

FIG. 8 shows a second embodiment of the present invention. In this embodiment, the guide bore 7 has a substantially uniform diameter throughout the length thereof, and the recess 14 of the first embodiment is omitted. Instead, the outer peripheral wall at the front end portion of the head 5 has a tapered configuration defined by inclined surfaces 5' converging toward the tip of the guide bore 7 on the upper and lower surfaces of the front end portion of the head.

The nail remover according to the present invention provides the following remarkable advantages:

(1) The nail remover is of a gun-type, by which nails remaining in plywood and the like can be removed. Accordingly, (a) since the nail removing operation is effected mechanically, the operability is improved and the labor is reduced, thus saving energy; (b) since the gun is light and small-sized and thus is easy to handle, even a woman can easily perform the nail removing operation; and (c) since the nail removing operation can be performed only by gripping the gun and pulling the trigger, the operation is very easy.

(2) Since the nail removing operation can be effected without turning the plywood over, the operability is improved.

(3) The peripheral wall defining the front end of the guide bore is tapered. Thus, even when the nail is so bent as to contact the plywood surface, the protruded portion of the nail can be easily introduced into the guide bore of the head only by sliding the tapered peripheral wall of the head on the plywood surface to urge against the free end of the nail and by gradually cocking the head.

(4) Since the push-rod is guided in the guide bore of the head, the push-rod is positively supported.

(5) Since the nail remaining in the plywood and the like is removed by pushing the nail by means of the push-rod advancing into the hole of the plywood, the nail removing operation can always be effected exactly.

(6) The nail remover has a simple construction and can be manufactured easily and inexpensively.

What is claimed is:

1. A nail remover comprising:

a tool head having a guide bore extending linearly through said head in a longitudinal direction so as to have an outlet at one end of the tool head and a rear opening at the other end of the tool head, and a pair of flat planar outer surfaces inclined relative to said longitudinal direction and converging toward one another in a direction toward said one end of the tool head, said flat planar surfaces terminating at the outlet of said guide bore such that a portion of said tool head leading up to the outlet of said guide bore has a tapered outer configuration;

a push-rod slidable in said tool head between a retracted position at which a free end of said push-rod is located within said guide bore and an extended position at which the free end of said push-rod protrudes from the outlet of said guide bore;

driving means for moving said push-rod between said retracted position and said extended position, said driving means comprising a housing having a cylinder therein, and a piston slidably mounted in said cylinder, said push-rod being fixed to said piston and extending from the center of a front surface thereof, and said tool head being fixed relative to said housing so as to be immovable relative thereto; and actuator means for allowing a supply of compressed air to be selectively introduced to and discharged from said cylinder to pneumatically operate said piston.

2. A nail remover according to claim 1, wherein said guide bore has a substantially uniform diameter between said outlet thereof at said one end of said tool head and the rear opening of said guide bore at the other end of said tool head.

3. A nail remover according to claim 1, wherein said guide bore has a substantially uniform diameter throughout a length thereof, and said guide bore has a portion thereof diverging outwardly toward said one end of the tool head defining the outlet of said guide bore.

4. A nail remover according to claim 1, wherein a free end of said push-rod has a semi-spherical recess therein.

5. A nail remover according to claim 2, wherein a free end of said push-rod has a semi-spherical recess therein.

6. A nail remover according to claim 3, wherein a free end of said push-rod has a semi-spherical recess therein.

* * * * *